US007819200B2

(12) United States Patent
Cornelissen et al.

(10) Patent No.: US 7,819,200 B2
(45) Date of Patent: Oct. 26, 2010

(54) METHOD OF CREATING AN ANNULAR SEAL AROUND A TUBULAR ELEMENT

(75) Inventors: Erik Kerst Cornelissen, Rijswijk (NL); Nouline Dijkstra, Rijswijk (NL); Paul Ouwerkerk, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 12/706,769

(22) Filed: Feb. 17, 2010

(65) Prior Publication Data

US 2010/0206589 A1 Aug. 19, 2010

(51) Int. Cl.
*E21B 33/12* (2006.01)

(52) U.S. Cl. ..... 166/387; 166/179

(58) Field of Classification Search ..... 166/179, 166/387

See application file for complete search history.

(56) References Cited

U.S. PATENT DOCUMENTS

| | | | | |
|---|---|---|---|---|
| 2,167,811 | A * | 8/1939 | Martin | 277/450 |
| 2,849,070 | A | 8/1958 | Maly | 166/179 |
| 3,385,367 | A | 5/1968 | Koisman | 166/191 |
| 3,706,342 | A | 12/1972 | Woolley | 166/134 |
| 6,296,054 | B1 | 10/2001 | Kunz et al. | 166/187 |
| 7,422,071 | B2 * | 9/2008 | Wilkie et al. | 166/387 |
| 7,562,704 | B2 * | 7/2009 | Wood et al. | 166/179 |
| 7,762,344 | B2 * | 7/2010 | Courville et al. | 166/387 |
| 2004/0112609 | A1 * | 6/2004 | Whanger et al. | 166/380 |
| 2006/0185849 | A1 * | 8/2006 | Edwards et al. | 166/296 |
| 2008/0290603 | A1 * | 11/2008 | Laflin | 277/334 |
| 2009/0211770 | A1 * | 8/2009 | Nutley et al. | 166/387 |
| 2010/0051295 | A1 * | 3/2010 | Courville et al. | 166/387 |

FOREIGN PATENT DOCUMENTS

| | | |
|---|---|---|
| WO | WO02059452 | 8/2002 |
| WO | WO2004057715 | 7/2004 |
| WO | WO2005012686 | 2/2005 |
| WO | WO2005090743 | 9/2005 |
| WO | WO 2009024553 A1 * | 2/2009 |

* cited by examiner

*Primary Examiner*—Kenneth Thompson

(57) ABSTRACT

A method is disclosed of creating an annular seal around a tubular element for use in a wellbore. The method comprises providing at least one seal layer of a flexible sealing material susceptible to swelling upon contact with a selected fluid, the seal layer having a first edge and a second edge, and helically winding each seal layer around the tubular element so that the first and second edges extend opposite each other along the tubular element and so that the first and second edges seal relative to each other upon swelling of the flexible sealing material. The tubular element is lowered into the wellbore, and the selected fluid is allowed to contact each seal layer so as to induce swelling of the flexible sealing material whereby the first and second edges seal relative to each other.

9 Claims, 3 Drawing Sheets

METHOD OF CREATING AN ANNULAR SEAL AROUND A TUBULAR ELEMENT

RELATED APPLICATIONS

Figure 1:
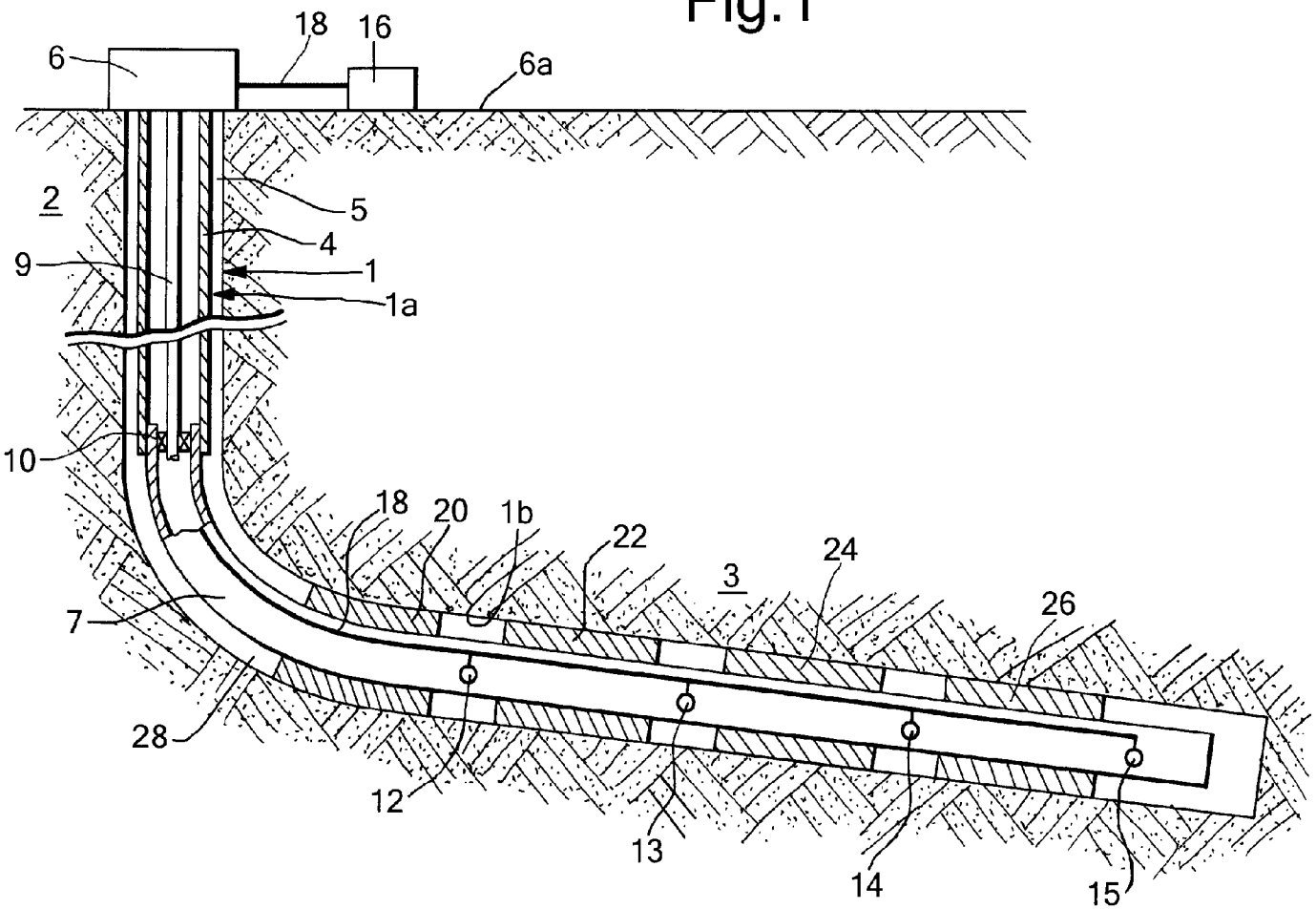

The present application claims priority from PCT/EP2008/060793, filed 18 Aug. 2008, which claims priority from European Patent Application 07114621.1 filed 20 Aug. 2007.

TECHNICAL FIELD OF THE INVENTION

The present invention relates to a method of creating an annular seal around a tubular element for use in a wellbore.

BACKGROUND OF THE INVENTION

In the field of hydrocarbon fluid production from a wellbore it is general practice to seal an annular space formed between an inner tubular wall and an outer tubular wall, such as between a production conduit and a surrounding casing, or between a casing and the wellbore wall. Various types of packers have been applied to provide such sealing functionality. Conventional packers generally are pre-fitted to tubular sections, often referred to as "subs", which are assembled to form the tubular element. Thus, during assembly of the tubular element it will be required to position the tubular sections provided with the packers at selected intervals corresponding to the depth locations where the packers are to be installed. However it has been experienced that the number of required packers, and the depth locations where these are to be installed, may not become apparent until during assembly and installation of the tubular element into the wellbore. Once the tubular element (or a portion thereof) has been assembled there is a reduced flexibility in setting the packers at the desired wellbore depths. Furthermore, pre-fitted packers generally need to be assembled with the respective tubular sections in a dedicated workshop remote from the wellbore site. Such remote assembly may further reduce the flexibility in applying packers to the tubular element during assembly at the wellbore site.

SUMMARY OF THE INVENTION

It is an object of the invention to provide an improved method of creating an annular seal around a tubular element for use in a wellbore, which overcomes the drawbacks of the prior art and provides enhanced flexibility during assembly of the tubular element.

In accordance with the invention there is provided a method of creating an annular seal around a tubular element for use in a wellbore, the method comprising:

a) providing at least one layer of a flexible sealing material susceptible to swelling upon contact with a selected fluid, said at least one layer having a first edge and a second edge;

b) helically winding each layer around the tubular element so that said first and second edges extend adjacent each other and seal relative to each other after swelling of the flexible sealing material;

c) lowering the tubular element into the wellbore;

d) allowing the selected fluid to contact each layer to induce swelling of the flexible sealing material so that the first and second edges seal relative to each other thereby forming the annular seal.

With the method of the preferred embodiment, it is achieved that during assembly and lowering of the tubular element into the wellbore, the seal layer can be applied to an already assembled portion of the tubular element. Thus there is enhanced flexibility in selecting locations along the tubular element where the seal layer(s) can be applied to the tubular element. Furthermore, with the method of the invention, assembly of the tubular element becomes independent from the availability of pre-fitted packers at the well site. Also, previous logistical problems due to the need to assemble pre-fitted packers in a dedicated workshop, are avoided.

It is preferred that step (a) comprises creating a helical cut in a tubular sleeve made of said flexible sealing material so as to form said at least one layer of flexible sealing material, the helical cut defining said first and second edges. In this manner the layer will assume a natural helical shape when in rest, so that the layer can be helically wound around the tubular element very easily. Also, the first and second edges will quickly seal relative to each other upon swelling of the layer since the edges naturally extend close to each other.

Suitably the first and second edges extend substantially parallel to each other, for example by providing the layer in the form of an elongate strip.

In a preferred embodiment the flexible sealing material is susceptible to swelling upon contact with water or hydrocarbon fluid, whereby for example the flexible sealing material includes an elastomer susceptible to swelling upon contact with water from the earth formation.

Suitably the swellable material is an elastomer adapted to swell when in contact with water and/or oil. Examples of materials that swell upon contact with hydrocarbon fluid are natural rubber, nitrile rubber, hydrogenated nitrile rubber, acrylate butadiene rubber, poly acrylate rubber, butyl rubber, brominated butyl rubber, chlorinated butyl rubber, chlorinated polyethylene, neoprene rubber, styrene butadiene copolymer rubber, sulphonated polyethylene, ethylene acrylate rubber, epichlorohydrin ethylene oxide copolymer, ethylene-propylene-copolymer (peroxide crosslinked), ethylene-propylene-copolymer (sulphur crosslinked), ethylene-propylene-diene terpolymer rubber, ethylene vinyl acetate copolymer, fluoro rubbers, fluoro silicone rubber, and silicone rubbers. Preferred materials are EP(D)M rubber (ethylene-propylene-copolymer, either peroxide or sulphur crosslinked), EPT rubber (ethylene-propylene-diene terpolymer rubber), butyl rubber, brominated butyl rubber, chlorinated butyl rubber, or chlorinated polyethylene.

Instead of, or in addition to, the swellable material being adapted to swell upon contact with hydrocarbon fluid, the swellable material suitably is adapted to swell upon contact with water. Suitably such water-swellable material is selected from rubber based on NBR, HNBR, XNBR, FKM, FFKM, TFE/P or EPDM. In order to enhance the swelling capacity of the water-swellable material, even for saline water conditions, said material suitably is a matrix material wherein a compound soluble in water is incorporated in the matrix material in a manner that the matrix material substantially prevents or restricts migration of the compound out of the swellable seal and allows migration of water into the swellable seal by osmosis so as to induce swelling of the swellable seal upon migration of said water into the swellable seal. Said compound suitably comprises a salt, for example at least 20 weight % salt based on the combined weight of the matrix material and the salt, preferably at least 35 weight % salt based on the combined weight of the matrix material and the salt. In order to prevent, or reduce, leaching of the compound out of the matrix material, it is preferred that the matrix material is substantially impermeable to said compound or to ions of said compound. The compound can be present in the matrix material, for example, in the form of a plurality of compound particles dispersed in the matrix material. If the matrix material is an elastomer, the compound can be mixed into the matrix material prior to vulcanization thereof.

If a control line extends along the tubular element, the layer preferably is provided with a recess in which the control line is accommodated during winding of the layer around the tubular element.

Preferably the layer is anchored to the tubular element, after being helically wound around the tubular element, at opposite end portions of the layer.

The annular seal created as described hereinbefore is suitably arranged to seal an annular space between the tubular element and a wall extending around the tubular element, said wall being selected from the wall of the wellbore, a casing extending into the wellbore, and a liner extending into the wellbore.

Figure 2:
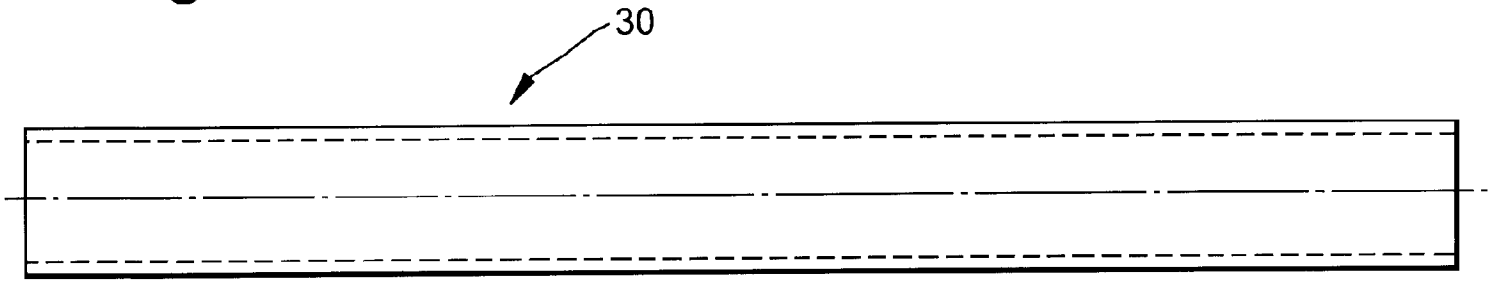
Figure 3:
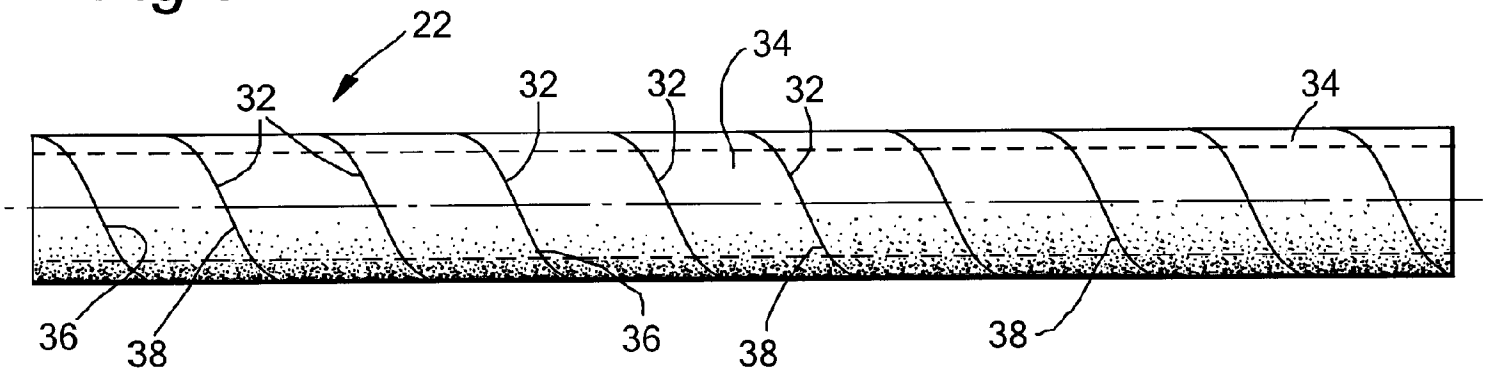
Figure 4:
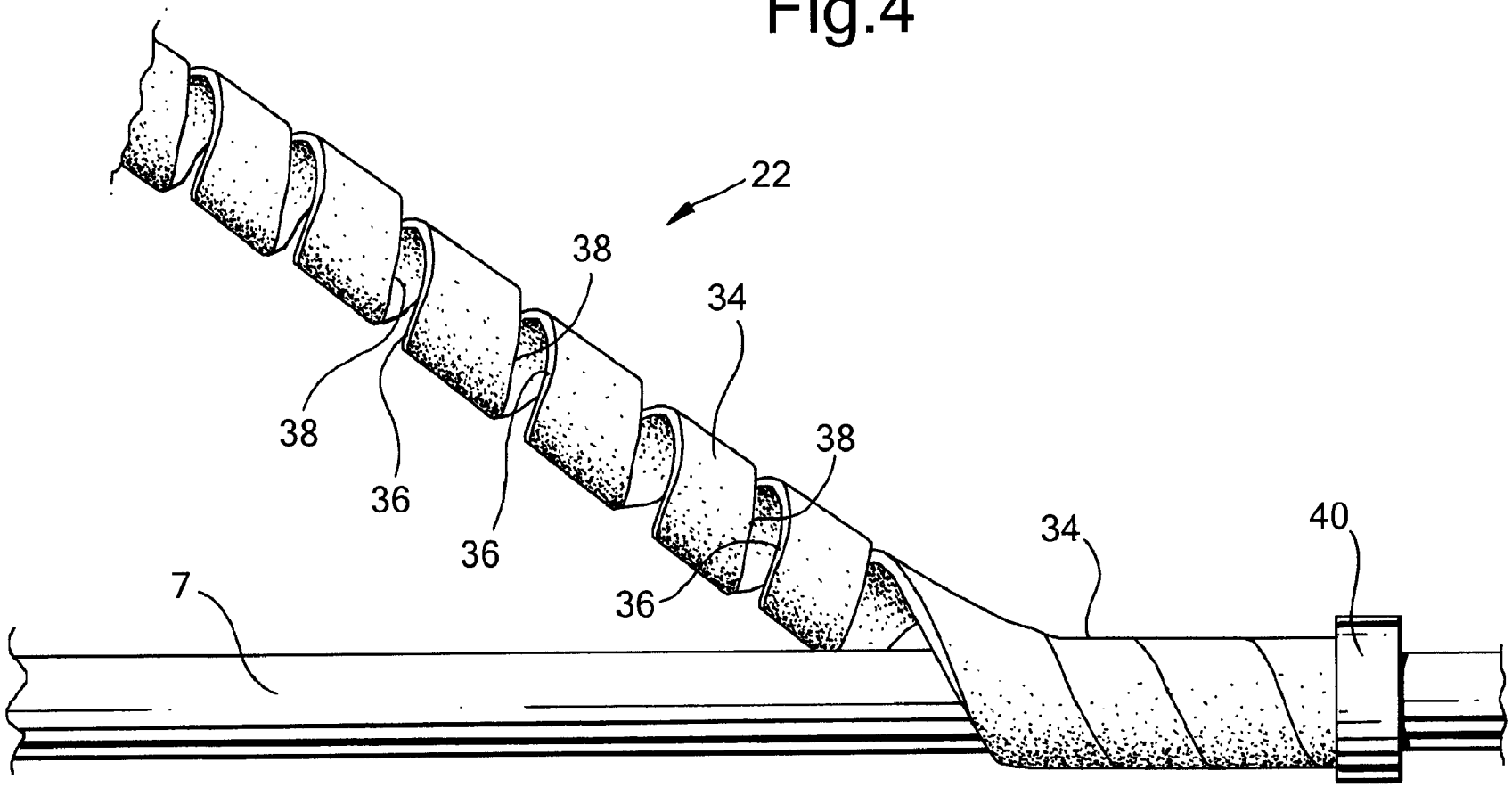

The invention will be described in more detail hereinafter by way of example, with reference to the accompanying drawings in which:

FIG. 1 schematically shows an embodiment of a wellbore conduit provided with annular seals in accordance with the method of the invention;

FIG. 2 schematically shows a side view of a tubular sleeve from which one of the annular seals of FIG. 1 is made;

FIG. 3 schematically shows the sleeve of FIG. 2 after a helical cut has been created therein to form a helical layer; and FIG. 4 schematically shows the helical layer of FIG. 3 during assembly to the tubular element.

In the drawings like reference numerals relate to like components.

DETAILED DESCRIPTION OF THE PREFERRED EMBODIMENTS

Referring to FIG. 1 there is shown a wellbore 1 formed in an earth formation 2 for the production of hydrocarbon fluid, the wellbore 1 having a substantially vertical upper section 1*a* and a substantially horizontal lower section 1*b* extending into a zone 3 of the earth formation from which hydrocarbon fluid is to be produced. The earth formation zone 3 is fractured whereby there is a risk that water from other formation zones (not shown) enters the lower wellbore section 1*b* via fractures in formation zone 3. The upper wellbore section 1*a* is provided with a casing 4 cemented in the wellbore by a layer of cement 5, said casing 4 extending to a wellhead 6 at surface 6*a*. A production liner 7 extends from the lower end part of the casing 4 into the substantially horizontal wellbore section 1*b*. A production tubing 9 provides fluid communication between the wellhead 6 and the production liner 7, whereby the production tubing 9 is sealed to the production liner 7 by a packer 10.

production liner 7 is provided with a plurality of inflow control devices in the form of inflow control valves 12, 13, 14, 15 spaced along the length of the liner 7. Each inflow control valve 12, 13, 14, 15 is connected to a control center 16 at surface via a set of electric control lines 18 extending along the outer surface of the production liner 7 and the inner surface of the casing 4, to allow each inflow control valve 12, 13, 14, 15 to be opened or closed from the control center 16.

A plurality of annular seals 20, 22, 24, 26 is arranged in the annular space 28 between the production liner 7 and the wall of wellbore section 1*b*, wherein the annular seals 20, 22, 24, 26 and the inflow control valves 12, 13, 14, 15 are arranged in alternating order in axial direction of the production liner 7. Each annular seal 20, 22, 24, 26 includes an elastomer susceptible to swelling upon contact with water from a water-bearing layer of the earth formation 2, for example HNBR elastomer.

Referring further to FIGS. 2 and 3 there is shown a tubular sleeve 30 from which one of the annular seals, such as annular seal 22, is made. The other annular seals 20, 24, 26 are made in a similar manner. The sleeve 30 has an inner diameter corresponding to the outer diameter of the production liner 7, and an outer diameter selected such that the annular seal 22 seals against the wellbore wall after swelling of its swellable elastomer.

To form the annular seal 22 from the sleeve 30, a helical cut 32 is created in the sleeve 30, said helical cut 32 extending the full length of the sleeve 30. The helical cut 32 extends fully through the wall of the sleeve 30 so that a helical seal layer 34 is formed having first and second edges 36, 38 extending substantially parallel to each other. The seal layer 34 will naturally assume a helical shape resembling the cylindrical shape of the sleeve 30 from which it is formed, provided the material of the sleeve 30 was not under a significant pre-load prior to making the cut 32. Thus, when the seal layer 34 assumes its natural shape the first and second edges 36, 38 extend parallel and close to each other. The sleeve 30 is at its inner surface provided with one or more recesses (not shown) extending in axial direction to accommodate the respective control lines 18.

Referring further to FIG. 4 there is shown the helical seal layer 34 during application to the production liner 7. An end portion of the seal layer 34 is fixedly connected to the production liner by means of an annular clamp 40.

During normal operation, the production liner 7 is assembled in a conventional manner from a plurality of tubular joints, and a plurality of short tubular sections (generally referred to as "subs") provided with the respective control valves 12, 13, 14, 15. Assembly occurs at the well site in progression with lowering of the production liner 7 into the wellbore 1. The control lines 18 are supplied and fixedly connected to the production liner 7 in correspondence with lowering of the production liner 7 into the wellbore 1.

Before, or during, lowering of the production liner 7 into the wellbore 1, the annular seal 22 is applied to the production liner 7 at the desired location. This is achieved by winding the seal layer 34 around the production liner in the manner shown in FIG. 4. Since the seal layer 34 tends to assume naturally a helical shape, corresponding to the helical shape after assembly to the production liner 7, the winding process is relatively easily. After winding a short section of the seal layer 34 around the production liner 7, clamp 40 is applied to the seal layer 34 so as to fixedly connect the seal layer 34 to the production liner 7. After the complete seal layer 34 is wound around the production liner 7, a similar clamp (not shown) is applied to the other end of the seal layer 34. During the winding process it is ensured that the first and second edges 36, 38 of adjacent windings extend parallel and close to each other. The actual distance can be selected in accordance with circumstances, however such that the first and second edges 36, 38 of adjacent windings seal relative to each other after swelling of the swellable elastomer of the seal layer. Thus, the annular seal 22 is formed from the seal layer 34 helically around the production liner 7. The other annular seals 20, 24, 26 are formed in a similar manner.

The production liner 7 is lowered into the wellbore 1 so that that the annular seals 20, 22, 24, 26 and the inflow control valves 12, 13, 14, 15 are located in the reservoir zone 3.

After suitably completing the wellbore 1, hydrocarbon fluid is allowed to flow from the reservoir zone 3 into the wellbore section 1*b* and thence via the inflow control valves 12, 13, 14, 15 into the production liner 7 and the production tubing 9. In the event that formation water enters the annular space between the production liner 7 and the wellbore wall, one or more of the seal layers 20, 22, 24, 26 contact the formation water and thereby swell until further swelling is prevented by the wellbore wall. The first and second edges 36, 38 of adjacent windings of the annular seal 22 become compressed against each other as a result of such swelling, thereby preventing fluid leakage between the edges 36, 38. Once the swollen annular seals 20, 22, 24, 26 are compressed between the production liner 7 and the wellbore wall, further migration of the formation water through the annular space is prevented.

To determine the location of water inflow, a test is carried by successively opening and/or closing the inflow control valves 12, 13, 14, 15 and simultaneously measuring the inflow of formation water. The location of inflow is determined from an observed reduced (or eliminated) inflow of formation water as a result of closing of one or more specific inflow control valves. Once the location of water inflow is determined, the respective inflow control valve 12, 13, 14, 15 is closed so that further inflow of formation water is eliminated.

Instead of allowing the annular seal to swell by contact with water from the earth formation, swelling of the annular seal can be triggered by bringing the annular seal into contact with water pumped into the wellbore. Such procedure has the advantage that the risk of premature swelling of the annular seal during lowering of the tubular element into the wellbore, is reduced.

Furthermore, the annular seal can be made of a material susceptible to swelling upon contact with hydrocarbon fluid, for example crude oil or diesel. In such applications the annular seal suitably is induced to swell by contacting it with hydrocarbon fluid produced from the wellbore or hydrocarbon fluid pumped into the wellbore.

Also, a hybrid system can be applied, in which the annular seal is susceptible to swelling upon contact with hydrocarbon fluid and upon contact with water.

What is claimed is:

1. A method of creating an annular seal around a tubular element for use in a wellbore, the method comprising:

a) providing at least one layer of a flexible sealing material susceptible to swelling upon contact with a selected fluid, said at least one layer having a first edge and a second edge;

b) helically winding each layer around the tubular element so that said first and second edges extend adjacent each other and seal relative to each other after swelling of the flexible sealing material;

c) lowering the tubular element into the wellbore;

d) allowing the selected fluid to contact each layer to induce swelling of the flexible sealing material so that the first and second edges seal relative to each other thereby forming the annular seal.

2. The method of claim 1 wherein step (a) comprises creating a helical cut in a tubular sleeve made of said flexible sealing material so as to form said at least one layer of flexible sealing material, the helical cut defining said first and second edges.

3. The method of claim 1 wherein the first and second edges extend substantially parallel to each other.

4. The method of claim 1 wherein the flexible sealing material is susceptible to swelling upon contact with water or hydrocarbon fluid.

5. The method of claim 4 wherein the flexible sealing material includes an elastomer susceptible to swelling upon contact with water from the earth formation or hydrocarbon fluid from the earth formation.

6. The method of claim 5 wherein the elastomer includes hydrogenated nitrile butadiene rubber (HNBR) elastomer.

7. The method of claim 1 wherein said layer is provided with a recess for accommodating a control line extending along the tubular element, and wherein the control line is accommodated in the recess during step (b).

8. The method of claim 1, further comprising after step (b), fixing said layer to the tubular element at opposite end portions of the layer.

9. The method of claim 1 wherein the annular seal is arranged to seal an annular space between the tubular element and a wall extending around the tubular element, said wall being selected from the wall of the wellbore, a casing extending into the wellbore, and a liner extending into the wellbore.

* * * * *